US011094522B2

(12) United States Patent
Miura et al.

(10) Patent No.: US 11,094,522 B2
(45) Date of Patent: Aug. 17, 2021

(54) MULTITURN TIME-OF-FLIGHT MASS SPECTROMETER AND METHOD FOR PRODUCING THE SAME

(71) Applicant: SHIMADZU CORPORATION, Kyoto (JP)

(72) Inventors: Hiroyuki Miura, Kyoto (JP); Hideaki Izumi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/060,692

(22) Filed: Oct. 1, 2020

(65) Prior Publication Data

US 2021/0111015 A1 Apr. 15, 2021

(30) Foreign Application Priority Data

Oct. 11, 2019 (JP) ..... JP2019-187364

(51) Int. Cl.
*H01J 49/40* (2006.01)

(52) U.S. Cl.
CPC ..... *H01J 49/408* (2013.01)

(58) Field of Classification Search
CPC ..... H01J 49/408
USPC ..... 250/281, 282, 283, 286, 287
See application file for complete search history.

(56) References Cited

U.S. PATENT DOCUMENTS

| | | | | |
|---|---|---|---|---|
| 9,082,602 | B2 | 7/2015 | Shchepunov et al. | |
| 2011/0180702 | A1* | 7/2011 | Flory | H01J 49/406 250/282 |
| 2011/0180705 | A1 | 7/2011 | Yamaguchi | |
| 2011/0248161 | A1* | 10/2011 | Takeshita | H01J 49/004 250/287 |
| 2012/0112060 | A1 | 5/2012 | Kinugawa et al. | |
| 2018/0138026 | A1* | 5/2018 | Stewart | H01J 49/0031 |
| 2020/0343081 | A1* | 10/2020 | McBride | H01J 41/16 |

FOREIGN PATENT DOCUMENTS

| | | | |
|---|---|---|---|
| JP | 2012-099424 | A | 5/2012 |
| JP | 2014-531119 | A | 11/2014 |
| WO | 2010/041296 | A1 | 4/2010 |
| WO | 2013/057505 | A2 | 4/2013 |

* cited by examiner

*Primary Examiner* — Nicole M Ippolito
(74) *Attorney, Agent, or Firm* — Sughrue Mion, PLLC

(57) ABSTRACT

To compensate for the distortion of the loop-flight electric field with a higher level of accuracy, a multiturn time-of-flight mass spectrometer 1 includes: a main electrode 21 configured to generate, within a predetermined loop-flight space, a loop-flight electric field which is an electric field that makes an ion fly in a loop orbit multiple times, the main electrode having an opening 24 or 25 through which ions are introduced into or extracted from the loop-flight space; a compensating-electrode attachment part 23 made of an insulating material and fixed to the main electrode; and a compensating electrode 22 configured to compensate for a distortion of the loop-flight electric field which occurs in the vicinity of the opening, the compensating electrode being fixed to the compensating-electrode attachment part directly or via a substrate 221 and located in the vicinity of the opening.

6 Claims, 7 Drawing Sheets

PLAN VIEW

SIDE VIEW

MULTITURN TIME-OF-FLIGHT MASS SPECTROMETER AND METHOD FOR PRODUCING THE SAME

TECHNICAL FIELD

The present invention relates to a multiturn time-of-flight mass spectrometer and its production method.

BACKGROUND ART

When a plurality of ions having different mass-to-charge ratios are accelerated by the same amount of energy, the ions fly at different speeds corresponding to their respective mass-to-charge ratios. Time-of-flight mass spectrometers (TOFMSs) make use of this fact and calculate the mass-to-charge ratio of an ion by measuring the length of time required for the ion to fly a predetermined distance. Accordingly, increasing the flight distance of the ions is effective for improving the resolving power in the TOFMS. However, in the case of a linear TOFMS which makes ions fly linearly or a reflectron TOFMS which makes ions fly in a round-trip path by using a reflecting electric field, increasing the flight distance of the ions requires the device to be larger in size in one specific direction (the direction of flight of the ions).

To address this problem, in recent years, the so-called "multiturn" time-of-flight mass spectrometer (MT-TOFMS) has been developed (for example, see Patent Literature 1). In a MT-TOFMS, ions are made to repeatedly fly in a loop orbit having a substantially circular shape, substantially elliptic shape, figure-"8" shape or similar shape. An electric field is created so that the orbit gradually changes its position for each turn of the ions, whereby the flight distance of the ions is increased without requiring the device to be larger in size in one specific direction. For example, a MT-TOFMS described in Patent Literature 1 includes a double-electrode structure formed by outer and inner electrodes. The outer electrode has a substantially spheroidal shape formed by a plurality of segment electrodes combined together. The inner electrode, which is located inside the spheroid of the outer electrode, also has a substantially spheroidal shape formed by a plurality of segment electrodes combined together which respectively face the segment electrodes forming the outer electrode. In this MT-TOFMS, an electric field for making ions repeatedly fly in the loop orbit ("loop-flight electric field") is created within the spheroidal space between the outer and inner electrodes ("loop-flight space") by voltages respectively applied to the segment electrodes. Ions are introduced into the loop-flight space through an ion inlet provided in the outer electrode. Due to the loop-flight electric field, the flying ions describe a trajectory which gradually revolves around the axis of the spheroidal space for each turn of the ions within the loop-flight space. After flying in the loop orbit multiple times, the ions are released through an ion outlet provided in the outer electrode to the outside of the loop-flight space, to be ultimately detected with an ion detector.

Since the orbit in the MT-TOFMS is formed so that the ions gradually change their position for each turn of the ions in the loop orbit, the ions pass through an area in the vicinity of the ion inlet in their first few turns. The ion inlet is an opening provided in the outer electrode. In the vicinity of this type of opening, the loop-flight electric field may be distorted (this is hereinafter called the "distorted electric field"), which may possibly disturb the orbit of the ions. The same also applies in the vicinity of the ion outlet. In view of this, the MT-TOFMS described in Patent Literature 1 has an electrode for compensating for the distortion of the loop-flight electric field (this electrode is hereinafter called the "compensating electrode") located in the vicinity of the ion inlet or outlet in addition to the electrode for creating the multiturn loop orbit (which is hereinafter called the "main electrode"; the outer and inner electrodes in the MT-TOFMS described in Patent Literature 1 correspond to the main electrode). The compensating electrode described in Patent Literature 1 has a plurality of metallic wires provided on a printed circuit board, with each wire individually given a potential to create a supplementary electric field (compensating electric field) in the vicinity of the ion inlet or outlet so as to compensate for the distortion of the loop-flight electric field created by the main electrode (distorted electric field).

CITATION LIST

Patent Literature

Patent Literature 1: WO2013/057505 A (JP 2014-531119 A)

SUMMARY OF INVENTION

Technical Problem

As noted earlier, the MT-TOFMS is characterized in that the device will not be large in size in one specific direction. Furthermore, downsizing the entire device while maintaining its resolving power can also be achieved by decreasing the size of the main electrode and increasing the number of turns by increasing the density of the loop orbit, i.e. by reducing the positional shift of the orbit which occurs for each turn of the ions in the loop orbit. Alternatively, the resolving power can be improved by increasing the number of turns by increasing the density of the loop orbit while maintaining the size of the main electrode. However, increasing the density of the loop orbit increases the chance of the ions coming close to the vicinity of the ion inlet or outlet during their flight in the loop orbit, making the ions more likely to be affected by the distorted electric field due to the ion inlet or outlet. Therefore, the compensation of the distorted electric field using the compensating electrode needs to be performed with an even higher level of accuracy.

The problem to be solved by the present invention is to provide a multiturn time-of-flight mass spectrometer and its production method which can compensate for the distortion of the loop-flight electric field with a higher level of accuracy and thereby allows the device to be smaller in size or higher in resolving power.

Solution to Problem

The multiturn time-of-flight mass spectrometer according to the present invention developed for solving the previously described problem includes:

a main electrode configured to generate, within a predetermined loop-flight space, a loop-flight electric field which is an electric field that makes an ion fly in a loop orbit multiple times, the main electrode having an opening through which ions are introduced into or extracted from the loop-flight space;

a compensating-electrode attachment part made of an insulating material and fixed to the main electrode; and a compensating electrode configured to compensate for a distortion of the loop-flight electric field which occurs in the vicinity of the opening, the compensating electrode being fixed to the compensating-electrode attachment part directly or via a substrate and located in the vicinity of the opening.

The "vicinity of the opening" means a range of distance from the opening within which the distortion of the electric field due to the opening affects the loop orbit of the ions to a non-negligible degree. In the case where the main electrode consists of inner and outer electrodes forming a loop-flight space, the "vicinity of the opening" should preferably be a range within which the distance from the opening is equal to or less than the distance between the outer and inner electrodes.

The multiturn time-of-flight mass spectrometer according to the present invention may preferably be configured as follows:

the compensating-electrode attachment part includes two positioning pins; and the compensating electrode or the substrate includes two fitting holes respectively provided for the two positioning pins.

The multiturn time-of-flight mass spectrometer according to the present invention can be produced in a preferable manner by the following method: The method for producing a multiturn time-of-flight mass spectrometer according to the present invention is a method for producing a multiturn time-of-flight mass spectrometer including a main electrode configured to generate, within a predetermined loop-flight space, a loop-flight electric field which is an electric field that makes an ion fly in a loop orbit multiple times, the main electrode having an opening through which ions are introduced into or extracted from the loop-flight space, and a compensating electrode configured to compensate for a distortion of the loop-flight electric field which occurs in the vicinity of the opening, and the method including the steps of:

fixing the compensating electrode, or a substrate to which the compensating electrode is attached, to a compensating-electrode attachment part made of an insulating material, using a jig which includes a compensating-electrode-holding portion configured to hold the compensating electrode and a compensating-electrode-attachment-part-holding portion configured to hold the compensating-electrode attachment part at a predetermined position relative to the compensating electrode, with the compensating electrode held in the compensating-electrode-holding portion and the compensating-electrode attachment part held in the compensating-electrode-attachment-part-holding portion; and fixing the compensating-electrode attachment part at a position in the vicinity of the opening.

Advantageous Effects of Invention

In a conventional MT-TOFMS, the compensating electrode is provided independently of the main electrode so that the compensating electrode will not come in contact with the main electrode. By comparison, in the MT-TOFMS according to the present invention, the compensating electrode is fixed to the main electrode via the compensating-electrode attachment part made of an insulating material. This allows the position of the compensating electrode relative to the main electrode to be more precisely set than in the conventional device. Therefore, the distorted electric field which occurs in the vicinity of the opening of the main electrode can be compensated for with a higher level of accuracy by the compensating electric field created by the compensating electrode, so that the downsizing of the device or an improvement in resolving power can be achieved.

In the case where the MT-TOFMS according to the present invention is configured so that the compensating-electrode attachment part includes two positioning pins while the compensating electrode or the substrate includes two fitting holes respectively provided for the two positioning pins, the position of the compensating electrode relative to the compensating-electrode attachment part can be even more precisely set, so that the distorted electric field can be compensated for with an even higher level of accuracy.

In the method for producing a MT-TOFMS according to the present invention, the position of the compensating electrode or the substrate to which the compensating electrode is attached can be more precisely set relative to the compensating-electrode attachment part by fixing the compensating electrode or the substrate to the compensating-electrode attachment part, with the compensating electrode held in the compensating-electrode-holding portion and the compensating-electrode attachment part held in the compensating-electrode-attachment-part-holding portion. The distorted electric field can thereby be compensated for with an even higher level of accuracy.

DESCRIPTION OF EMBODIMENTS

An embodiment of the MT-TOFMS and its production method according to the present invention is hereinafter described with reference to FIGS. 1A-9B.

(1) Embodiment of MT-TOFMS According to Present Invention

Figure 1A:
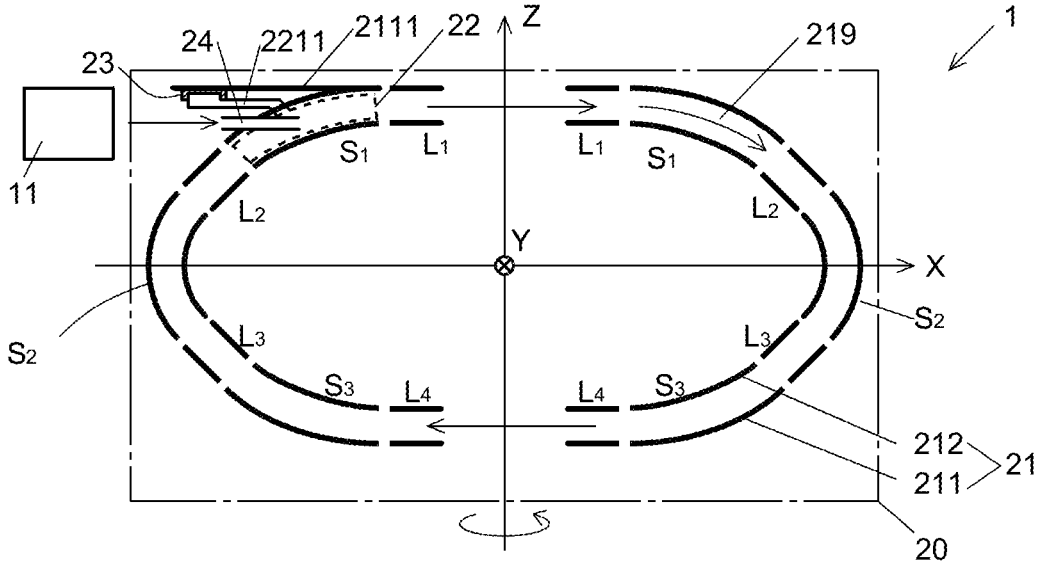
FIGS. 1A and 1B are a vertical sectional view and a top view of one embodiment of the MT-TOFMS according to the present invention, respectively.
Figure 1B:
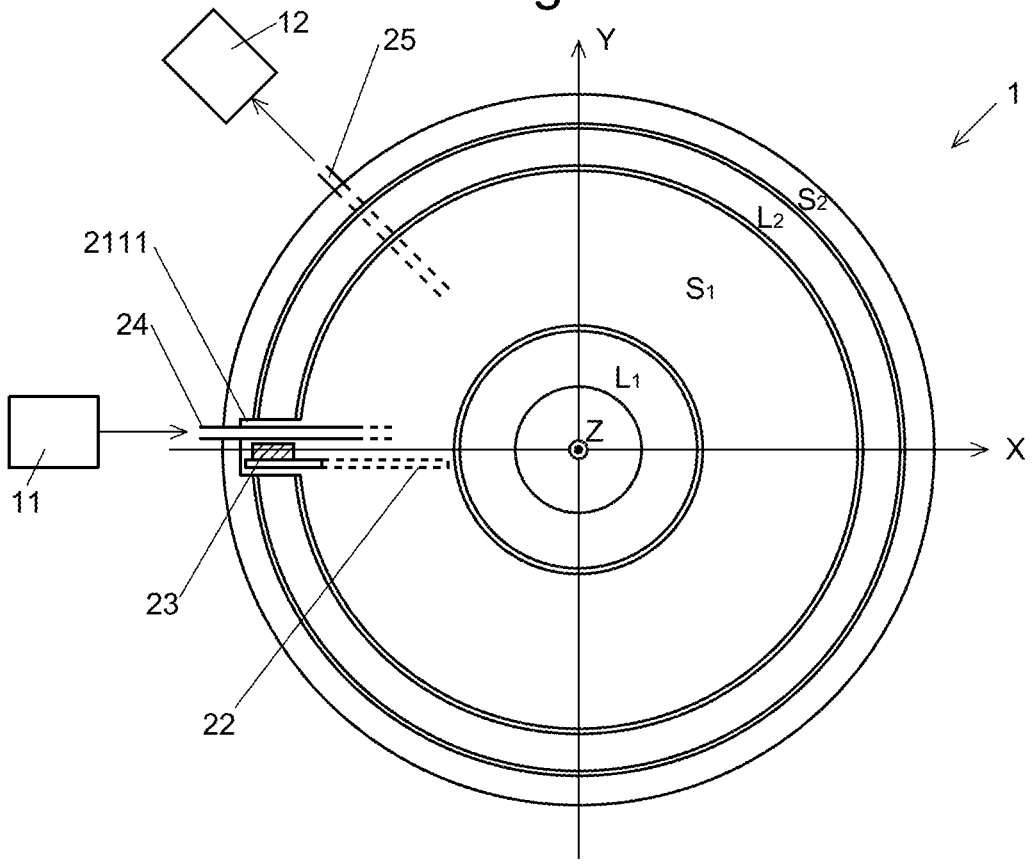

FIGS. 1A and 1B are schematic diagrams showing a MT-TOFMS 1 according to the present embodiment. The MT-TOFMS 1 includes an ion source 11, ion flight unit 20, and ion detector 12.

The ion source 11 includes, for example, an ionizer configured to ionize a sample and an ion trap configured to temporarily hold ions. A large number of ions having various mass-to-charge ratios are produced by the ionizer. Those ions are temporarily captured within the ion trap. At a predetermined point in time, a predetermined amount of energy is imparted to the ions to simultaneously eject them in the form of an ion packet.

The ion flight unit 20 includes a main electrode 21, compensating electrode 22 and compensating-electrode attachment part 23.

The main electrode 21 includes a substantially spheroidal outer electrode 211 and a substantially spheroidal inner electrode 212 which is located inside the outer electrode 211. FIG. 1A shows a vertical sectional view of the electrodes at the ZX plane, which is a plane containing both the Z-axis that is the axis of rotation of the substantially spheroidal shape of the outer and inner electrodes 211 and 212, and the X-axis that is an axis orthogonal to the Z-axis. Cutting the main electrode 21 at a plane which contains the Z-axis always reveals a section having substantially the same shape as shown in FIG. 1A, regardless of the angle of orientation of the section (i.e. the angular position around the Z-axis). The top view in FIG. 1B shows an appearance of the main electrode 21 as viewed from the positive side of the Z-axis. An axis orthogonal to both the Z-axis and X-axis is the Y-axis. A plane containing both the X-axis and Y-axis is the XY plane.

The outer and inner electrodes 211 and 212 are formed by three partial-electrode pairs $S_1$, $S_2$ and $S_3$ each of which consists of a pair of electrodes having a curved shape in the ZX-plane and facing each other, combined with four partial-electrode pairs $L_1$, $L_2$, $L_3$ and $L_4$ each of which consists of a pair of electrodes having a linear shape in the ZX-plane and facing each other. The partial-electrode pair $S_2$ as viewed on the ZX-plane is located at both ends of the main electrode 21 in the X-direction and has a symmetrical shape with respect to the X-axis. The partial-electrode pair $S_1$ is located on the positive side of the Z-direction as viewed from the partial-electrode pair $S_2$. The partial-electrode pair $S_3$ is located on the negative side of the Z-direction as viewed from the partial-electrode pair $S_2$ and is symmetrical to the partial-electrode pair $S_1$ with respect to the X-axis. The partial-electrode pair $L_2$ is located between the partial-electrode pairs $S_1$ and $S_2$. The partial-electrode pair $L_3$ is located between the partial-electrode pairs $S_2$ and $S_3$, having a symmetrical shape to the partial-electrode pair $L_2$ with respect to the X-axis. The partial-electrode pair $L_1$ is shaped like a doughnut plate perpendicular to the Z-axis and is located on the positive side of the Z-direction as well as inside the partial-electrode pair $S_1$ when projected onto the XY-plane. The partial-electrode pair $L_4$ is located on the negative side of the Z-direction and is symmetrical to the partial-electrode pair $L_1$ with respect to the X-axis.

By the combination of those partial-electrode pairs, each of the outer and inner electrodes 211 and 212 exhibits a substantially spheroidal overall shape. For example, the outer electrode 211 has an external shape measuring 500 mm in the major-axis direction (X or Y direction) and 300 mm in the minor-axis direction (Z-direction). The distance between the outer and inner electrodes 211 and 212 is 20 mm. Reducing the entire size of the outer and inner electrodes 211 and 212 allows for the downsizing of the entire MT-TOFMS 1.

The partial-electrode pairs $S_1$, $S_2$ and $S_3$ which are curved in the ZX-plane are given potentials from a power source (not shown) so that an electric field directed from the outer electrode 211 to the inner electrode 212 is created. On the other hand, the partial-electrode pairs $L_1$, $L_2$, $L_3$ and $L_4$ which are linear in the ZX-plane are given the same potential to both of the outer and inner electrodes 211 and 212 from a power source (not shown). Thus, a loop-flight electric field which makes ions fly in a loop orbit within the space between the outer and inner electrodes 211 and 212 is created within this space. This space is hereinafter called the "loop-flight space" 219.

Figure 2:
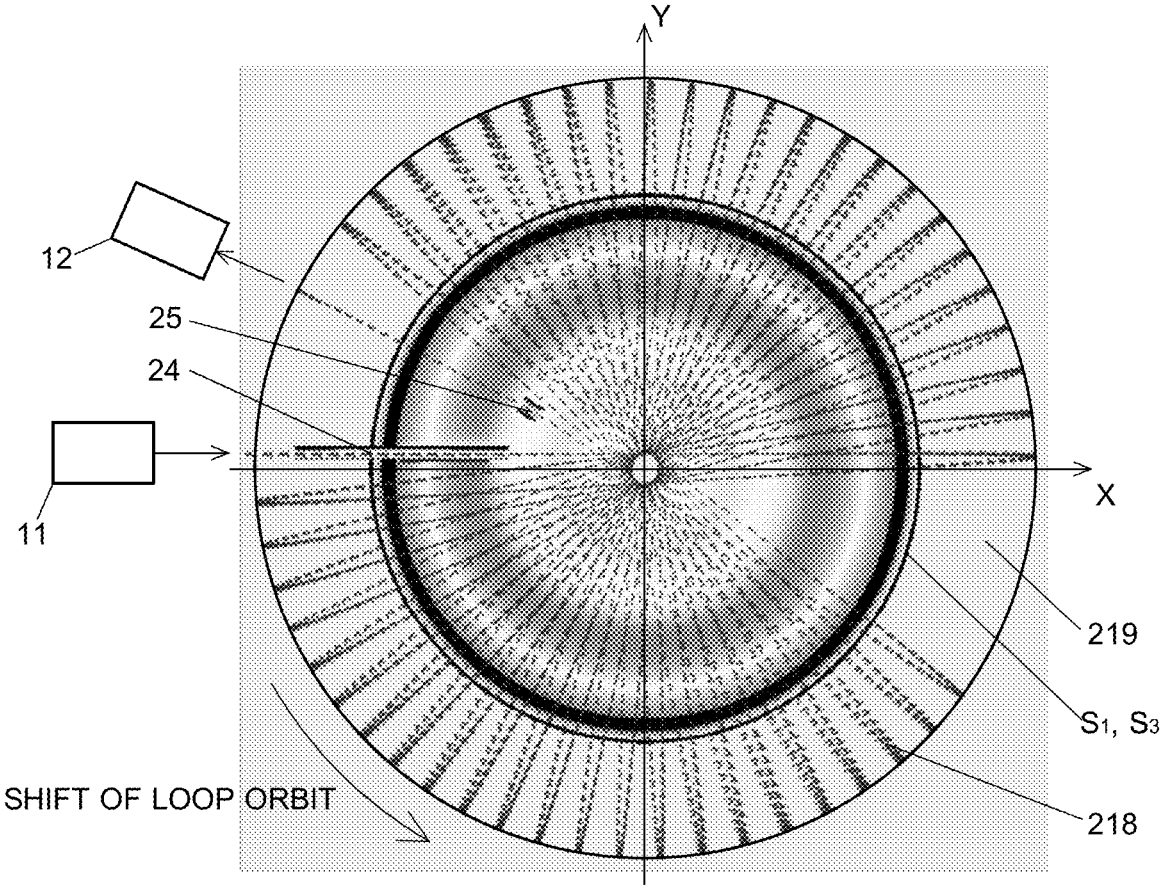
FIG. 2 is a top view showing an orbit of ions in the MT-TOFMS according to the present embodiment.

The partial-electrode pair $S_1$ in the outer electrode 211 is provided with an ion inlet 24 for introducing ions ejected from the ion source 11 into the loop-flight space 219. The ion inlet 24 is located at a position slightly displaced from the X axis toward the positive side of the Y-direction, and is arranged so that the ions from the ion source 11 are injected substantially parallel to the X-axis. The ions undergo a centripetal force from the loop-flight electric field created by the partial-electrode pair $S_1$ at a position immediately after the point of injection from the ion inlet 24 into the loop-flight space 219. Additionally, due to the displacement of the ion inlet 24 from the X-axis toward the positive side of the Y-direction, the ions also undergo a force directed toward the X-direction. Consequently, the flying ions describe a trajectory 218 in which the ions turn along a substantially elliptic orbit multiple times within the loop-flight space 219, with the loop orbit gradually changing its orientation counterclockwise as viewed from the positive side of the Y-direction for each turn of the ions (see FIG. 2). In FIG. 2, the trajectory 218 of the ions is shown by a projection onto the XY-plane.

The partial-electrode pair $S_3$ is provided with an ion outlet 25 for extracting ions from the loop-flight space 219 after the ions have made the loop flight a plurality of times (tens of times) within the loop-flight space 219. The ions extracted from the ion outlet 25 fly in a straight path. The ion detector 12 is located on this straight path.

Due to the configuration of the ion source 11, main electrode 21 and ion detector 12 described thus far, the large number of ions having various mass-to-charge ratios ejected from the ion source 11 are separated from each other by mass by flying in the loop-flight space 219 inside the main electrode 21 and being individually detected by the ion detector 12 having temporal differences corresponding to their respective mass-to-charge ratios. However, at a position near the ion inlet 24 which the ions pass through immediately after their injection into the loop-flight space 219, a distortion of the electric field occurs due to the presence of the opening as the ion inlet 24 in the outer electrode 211. If no measure is taken, the orbit of the ions will be displaced from the intended position, and it may be impossible to extract the ions from the ion outlet 25. To solve this problem, the MT-TOFMS 1 according to the present embodiment is provided with the compensating electrode 22.

Figure 3A:
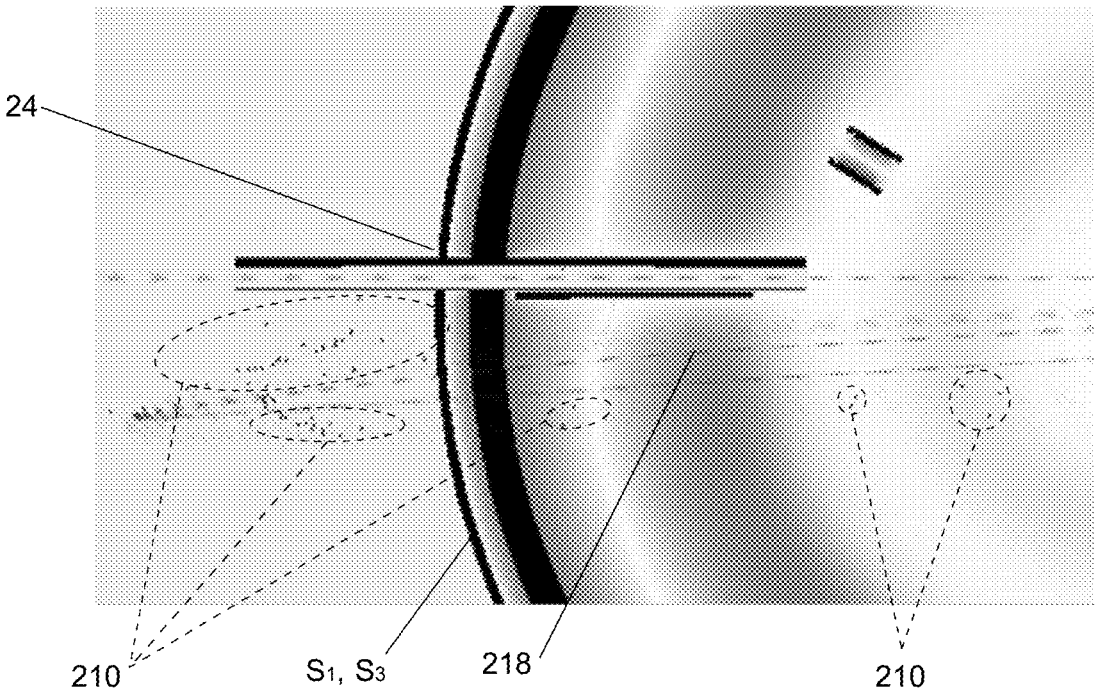
FIG. 3A is a graphical image obtained by a simulation of the trajectory of ions flying in the vicinity of an ion inlet in the MT-TOFMS according to the present embodiment under the condition that the compensating electrode has been removed.
Figure 4:
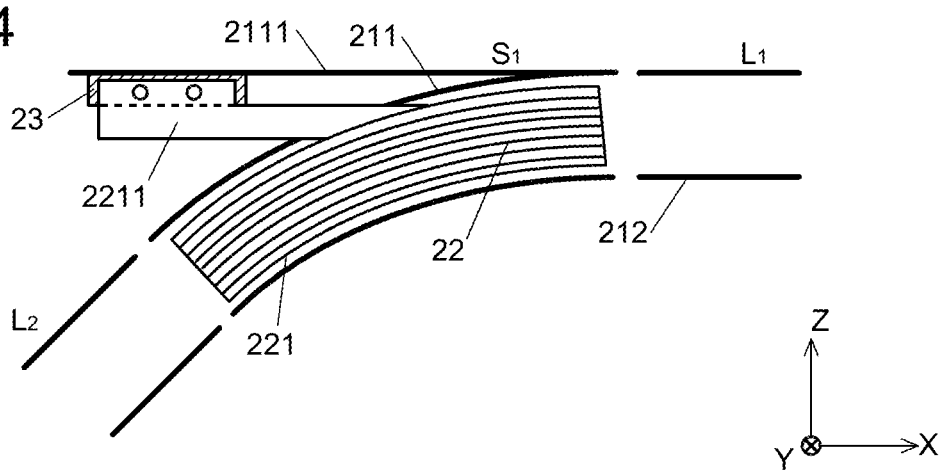
FIG. 4 is an enlarged vertical sectional view of a portion of the MT-TOFMS according to the present embodiment.

As shown in FIG. 1A and FIG. 4, which is a partially enlarged view of FIG. 1A, the compensating electrode 22 is located within the area sandwiched between the partial-electrode pair $S_1$ in the loop-flight space 219. When projected onto the XY-plane (FIG. 1B), the compensating electrode 22 is located on the negative side of the Y-direction as viewed from the ion inlet 24 and is closer to the ion inlet 24 than the position in the loop orbit at which the ions introduced from the ion inlet 24 complete their first turn, being displaced so as not to overlap the loop orbit. The distance between the ion inlet 24 and the compensating electrode 22 is less than 10 mm, which is smaller than the distance between the outer and inner electrodes 211 and 212, i.e. 20 mm. The position of the compensating electrode 22 is within a range where ions would be affected by the distortion of the electric field caused by the ion inlet 24 if the compensating electrode 22 were not present (or if the compensating electrode 22 is not in operation). That is to say, this position corresponds to the "vicinity of the opening (ion inlet 24)" described earlier. FIG. 3A shows the trajectory of ions flying in the vicinity of the ion inlet 24 determined by a simulation performed for the MT-TOFMS 1 according to the present embodiment under the condition that the compensating electrode 22 has been removed. As shown in this figure, if the compensating electrode 22 is not present (or is not in operation), a portion 210 of the ions introduced from the ion inlet 24 is dispersed in an area near the position at which the ions have completed their first turn in the trajectory 218. This result demonstrates that the ions are affected by the distortion of the electric field at the position where the compensating electrode 22 should be located.

Figure 3B:
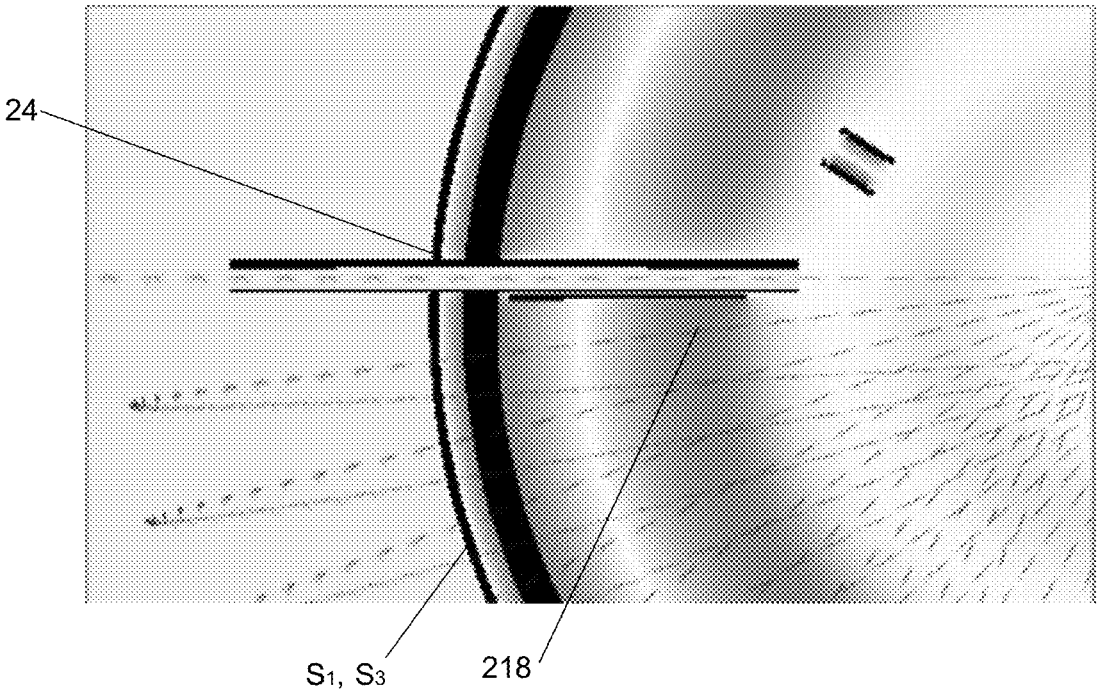
FIG. 3B is a graphical image obtained by a simulation of the trajectory of ions flying in the vicinity of an ion inlet in the MT-TOFMS according to the present embodiment under the condition that the compensating electrode is in operation.

The compensating electrode 22 is formed by a plurality of linear conductors which extend along the curve of the partial-electrode pair $S_1$ in the ZX-plane and are arranged from the outer electrode 211 toward the inner electrode 212. The compensating electrode 22 is attached to the surface of a substrate 221 made of an insulating material (in the present embodiment, alumina). A substrate-projecting portion 2211, which is a portion of the substrate 221, projects to the outside of the main electrode 21 through a hole formed in the outer electrode 211. A power source (not shown) is connected to each linear conductor, whereby a compensating electric field directed from the outer electrode 211 toward the inner electrode 212 is created. This compensating electric field compensates for the distorted electric field created by the main electrode 21 due to the presence in the outer electrode 211 of the opening as the ion inlet 24 and the hole for the substrate 221 to pass through. FIG. 3B shows the trajectory of ions flying in the vicinity of the ion inlet 24 determined by a simulation performed for the MT-TOFMS 1 according to the present embodiment under the condition that the compensating electrode 22 is in operation. The dispersion of the ions does not occur when the compensating electrode 22 is in operation. This demonstrates that the distorted electric field is compensated for.

However, if the compensating electrode 22 is not located at the correct position within the loop-flight space 219, the compensating electric field will not be created as designed, and it will be impossible to compensate for the distorted electric field. In particular, if the entire size of the outer and inner electrodes 211 and 212 is reduced without decreasing the flight distance of the ions (i.e. without lowering the resolving power), or if the flight distance of the ions is increased, the ions will be more likely to undergo the influence of the distorted electric field in the vicinity of the ion inlet 24 since the spatial interval of the loop orbit will be decreased in those situations. For example, if the outer diameter of the outer electrode 211 in the major-axis direction is changed from 700 mm to 500 mm (while the distance between the outer and inner electrodes 211 and 212 is unchanged, 20 mm), the spatial interval of the loop orbit will decrease from approximately 50 mm to 10 mm or smaller, so that the flying ions will come even closer to the ion inlet 24. This affects the required accuracy of the attachment position of the compensating electrode 22: when the outer diameter of the outer electrode 211 in the major-axis direction is 700 mm, the accuracy only needs to be no greater than 500 μm. By comparison, when the outer diameter is 500 mm, the accuracy needs to be equal to or less than 100 μm. To address this problem, the MT-TOFMS 1 according to the present embodiment employs a compensating-electrode attachment part 23 with which the compensating electrode 22 can be arranged with a higher level of positional accuracy. It should be noted that the use of the compensating-electrode attachment part 23 is not limited to the case where the accuracy of the attachment position of the compensating electrode 22 should be equal to or less than 100 μm; it may also be used in the case where a lower level of positional accuracy is acceptable (e.g. equal to or less than 500 μm).

Figure 5A:
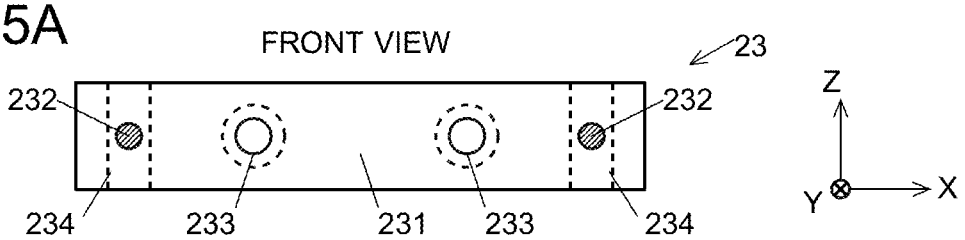
FIGS. 5A and 5B are a front view and a top view of the compensating-electrode attachment part in the MT-TOFMS according to the present embodiment.
Figure 5B:
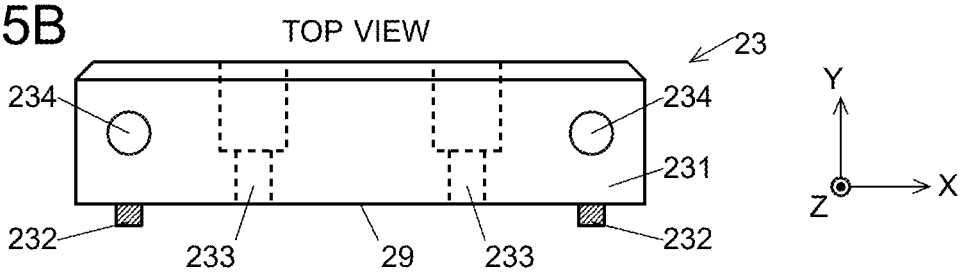

The configuration of the compensating-electrode attachment part 23 is hereinafter described. Reference to the direction of the compensating-electrode attachment part 23 will be made on the assumption that this part is attached to the main electrode 21. As shown in FIGS. 5A and 5B, the compensating-electrode attachment part 23 includes a parallelepiped body 231 made of a substantially rectangular insulator, two cylindrical positioning pins 232 projecting from the surface of the body 231 on the negative side of the Y-direction (this surface is hereinafter called the "compensating-electrode attachment surface" 29), two compensating-electrode-fixing-bolt insertion holes 233 penetrating through the body 231 in the Y-direction, and two main-electrode-fixing-bolt insertion holes 234 penetrating through the body 231 in the Z-direction.

Figure 6A:
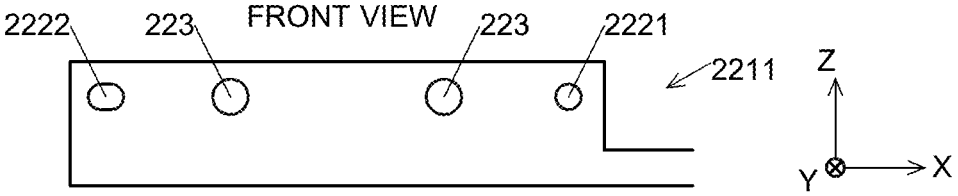
FIGS. 6A and 6B are a front view and a top view of a substrate-projecting portion of the compensating electrode in the MT-TOFMS according to the present embodiment, respectively.
Figure 6B:
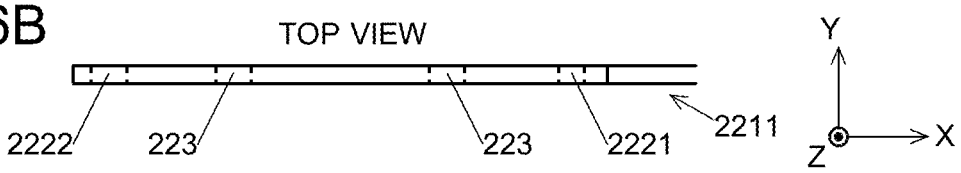

The substrate-projecting portion 2211 of the compensating electrode 22 is configured to be attached to the surface of the body 231 of the compensating-electrode attachment part 23 on the negative side of the Y-direction, with its plate surface directed parallel to the ZX-plane. As shown in FIGS. 6A and 6B, the substrate-projecting portion 2211 has two positioning-pin-fitting holes 2221 and 2222 as well as two compensating-electrode-fixing-bolt connection holes 223 corresponding to the positions of the two positioning pins 232 and the two compensating-electrode-fixing-bolt insertion holes 233 of the compensating-electrode attachment part 23, respectively. The positioning-pin-fitting hole 2221, which is one of the two positioning-pin-fitting holes and is located closer to the compensating electrode 22, has a circular plan-view shape which is substantially identical to the outer shape of the cylindrical positioning pin 232. The other positioning-pin-fitting hole 2222 is in the form of a long hole whose width in the Z-direction is substantially equal to that of the positioning pin 232, while its width in the X-direction is larger than that of the positioning pin 232.

Figure 7A:
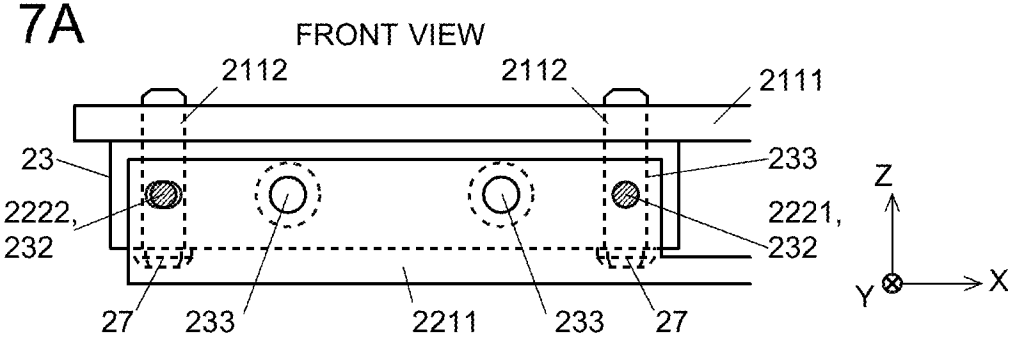
FIGS. 7A and 7B are a front view and a top view of the compensating-electrode attachment part to which the compensating electrode is attached, and the main electrode to which the compensating-electrode attachment part is attached, in the MT-TOFMS according to the present embodiment.
Figure 7B:
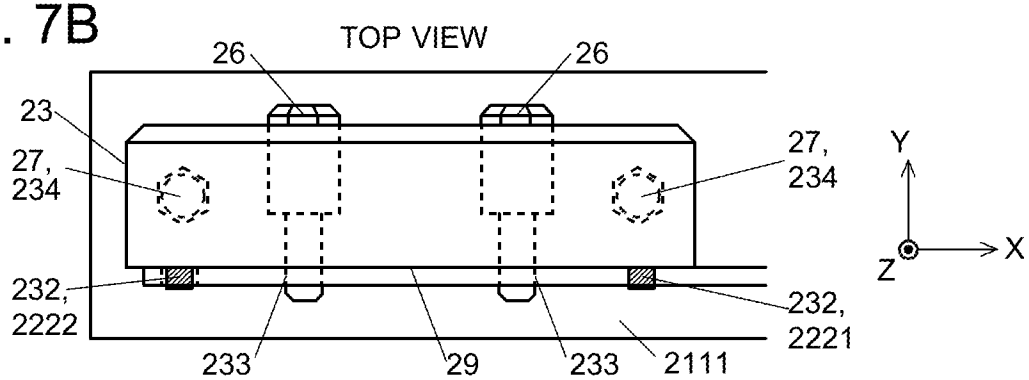

As shown in FIGS. 4, 7A and 7B, the portion belonging to the partial-electrode pair $S_1$ in the outer electrode 211 has an attachment-part-fixing portion 2111 projecting outward. The attachment-part-fixing portion 2111 has two main-electrode-fixing-bolt connection holes 2112 corresponding to the two main-electrode-fixing-bolt insertion holes 234 of the compensating-electrode attachment part 23. It should be noted that the substrate-projecting portion 2211 and the compensating-electrode attachment part 23, which are actually located behind (below) the attachment-part-fixing portion 2111 and should not be visible on a top view, are shown by solid lines in the top view of FIG. 7B for convenience of description.

As shown in FIGS. 7A and 7B, the substrate-projecting portion 2211 of the compensating electrode 22 is fixed to the compensating-electrode attachment part 23 by making the substrate-projecting portion 2211 be in tight contact with the surface of the compensating-electrode attachment part 23 on the negative side of the Y-direction, inserting the two positioning pins 232 into the two positioning-pin-fitting holes 2221 and 2222, respectively, as well as inserting two compensating-electrode-fixing bolts 26 into the two compensating-electrode-fixing-bolt insertion holes 233, respectively, and connecting those bolts 26 to the compensating-electrode-fixing-bolt connection holes 223. Additionally, the compensating-electrode attachment part 23 is fixed to the attachment-part-fixing portion 2111 formed on the outer electrode 211 of the main electrode 21, by inserting two main-electrode-fixing bolts 27 into the two main-electrode-fixing-bolt insertion holes 234, respectively, and connecting those bolts to the main-electrode-fixing-bolt connection holes 2112. Thus, the compensating electrode 22 is fixed to the main electrode 21 via the compensating-electrode attachment part 23.

The position and cylindrical diameter of the two positioning pins 232, the position and diameter of the first positioning-pin-fitting hole 2221 as well as the position and Z-directional width of the second positioning-pin-fitting hole 2222 have a smaller amount of production tolerance (e.g. 10-30 μm) than the compensating-electrode-fixing-bolt connection holes 223 and the compensating-electrode-fixing-bolt insertion holes 233. Therefore, the position of the compensating electrode 22 in the X-direction is accurately determined by the first positioning-pin-fitting hole 2221 and the positioning pin 232 inserted into this hole (e.g., if the tolerance is 10-30 μm, the positional error will not exceed 100 μm). The second positioning-pin-fitting hole 2222, which is shaped like a long hole whose width in the X-direction is larger than that of the positioning pin 232, prevents the two positioning pins 232 from being difficult to be inserted into the positioning-pin-fitting holes 2221 and 2222 due to a small amount of error that is within the tolerance. The position of the compensating electrode 22 in the Z-direction is accurately determined by the two positioning-pin-fitting holes 2221 and 2222 as well as the positioning pins 232 inserted into those holes. The position of the compensating electrode 22 in the Y-direction is accurately set by making the substrate-projecting portion 2211 of the compensating electrode 22 be in tight contact with the compensating-electrode attachment surface 29.

As described thus far, in the MT-TOFMS 1 according to the present embodiment, since the position of the compensating electrode 22 is accurately set, the distorted electric field which occurs in the vicinity of the ion inlet 24 can be compensated for with a higher level of accuracy by the compensating electric field. Accordingly, the influence of the distorted electric field can be reduced even when the position of the orbit at the completion of the first turn of the ions has been closer to the ion inlet 24 as a result of a decrease in the shift of the loop orbit which occurs for every turn of the ions, in order to downsize the main electrode 21 or improve the resolving power. Thus, according to the present embodiment, it is possible to make a MT-TOFMS smaller in size or higher in resolving power.

(2) First Modified Example of MT-TOFMS According to Present Embodiment

Figure 8A:
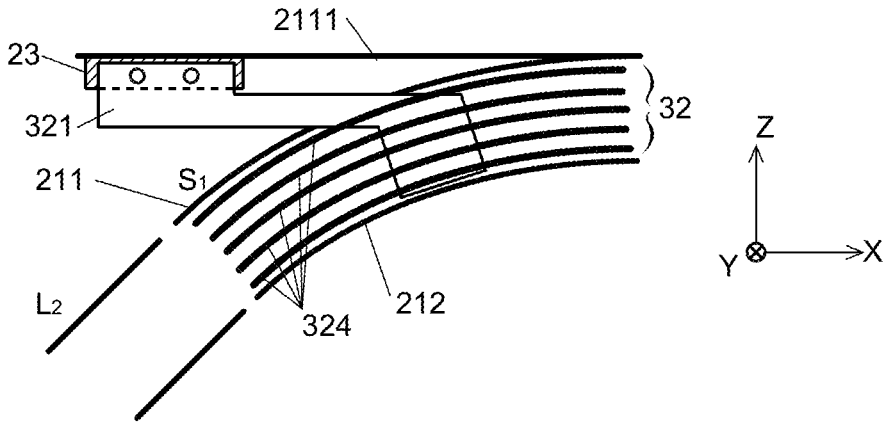
FIG. 8A is a front view of the compensating-electrode attachment part to which the compensating electrode is attached.
Figure 8B:
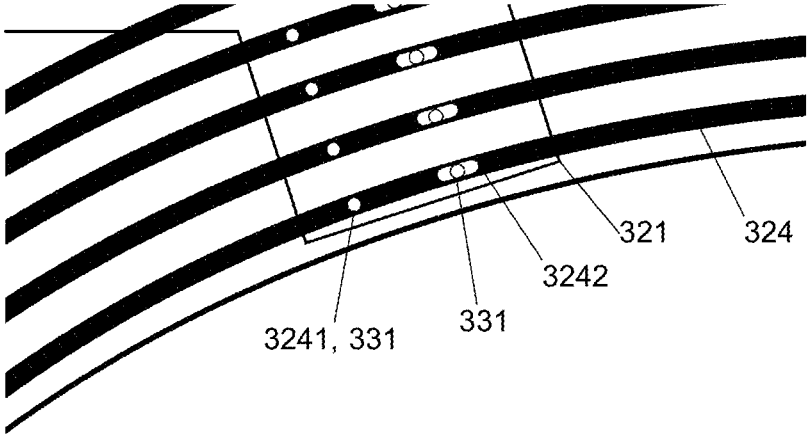
FIG. 8B is a partially enlarged view of the same part.
Figure 8C:
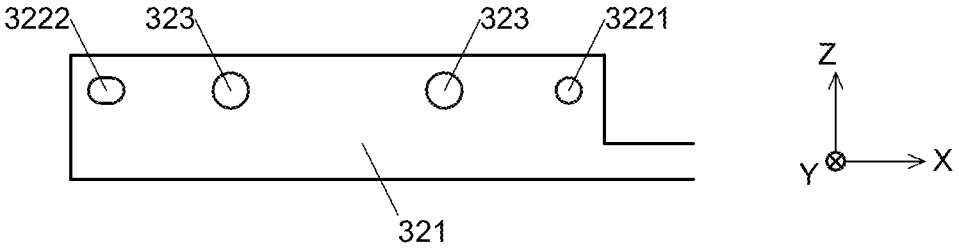
FIG. 8C is a partially enlarged view of the substrate, in a MT-TOFMS according to a modified example.

The first modified example of the MT-TOFMS according to the present embodiment is hereinafter described with reference to FIGS. 8A-8C. In the first modified example of the MT-TOFMS, the configuration of the compensating electrode 32 is different from that of the compensating electrode 22 in the MT-TOFMS 1 according to the previous embodiment. The configurations of the components other than the compensating electrode 32 (main electrode 21, compensating-electrode attachment part 23, ion source 11 and ion detector 12) are identical to those of the previous embodiment.

The compensating electrode 32 has a plurality of conductors 324 having a curved shape along the curve of the partial-electrode pair $S_1$ in the ZX-plane and arranged from the outer electrode 211 toward the inner electrode 212, with each conductor 324 having a certain degree of rigidity (for maintaining the curved shape). Each conductor 324 has two positioning-pin-fitting holes 3241 and 3242 penetrating through the conductor in the Y-direction. The first positioning-pin-fitting hole 3241 has a circular shape, while the second positioning-pin-fitting hole 3242 is in the form of a long hole extending along the curve of the conductor 324.

The compensating electrode 32 is attached to a substrate 321 made of an insulating material. The substrate 321 is provided with positioning pins 332 extending toward the negative side of the Y-direction (these pins are not the positioning pins 232 provided on the compensating-electrode attachment part 23). The number of positioning pins 332 is two times the number of conductors 324. Each conductor 324 is screwed to the substrate 321, with one positioning pin 332 inserted in each of the positioning-pin-fitting holes 3241 and 3242. The substrate 321 holds only a portion of the compensating electrode 32 and has a smaller area than the substrate 221 in the MT-TOFMS 1 according to the previous embodiment. This configuration suppresses the accumulation of electric charges ("charge-up") in the substrate 321 made of an insulating material within the loop-flight space 219.

The substrate 321 is further provided with two positioning-pin-fitting holes 3221 and 3222 as well as two compensating-electrode-fixing-bolt connection holes 323 (FIG. 8C), as with the substrate 221 in the previous embodiment. The substrate 321 is fixed to the compensating-electrode attachment part 23 by inserting two compensating-electrode-fixing bolts 26 through the two compensating-electrode-fixing-bolt insertion holes 233, respectively, and connecting those bolts 26 to the compensating electrode-fixing-bolt connection holes 323, with the positioning pins 232 on the compensating-electrode attachment part 23 inserted into the positioning-pin-fitting holes 3221 and 3222, respectively. This compensating-electrode attachment part 23 is fixed to the main electrode 21, as in the MT-TOFMS 1 according to the previous embodiment. Thus, the compensating electrode 32 fixed to the substrate 321 is held in a predetermined position within the loop-flight space 219 with a high level of positional accuracy.

Figure 9A:
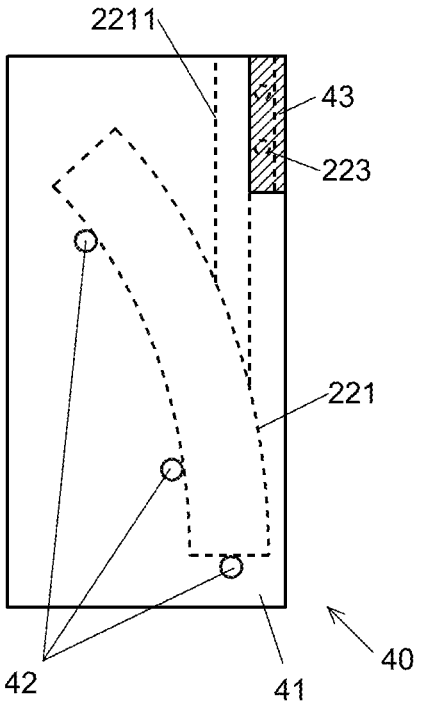
FIGS. 9A and 9B are a plan view and a side view of a jig used for producing a MT-TOFMS according to another modified example, respectively.
Figure 9B:
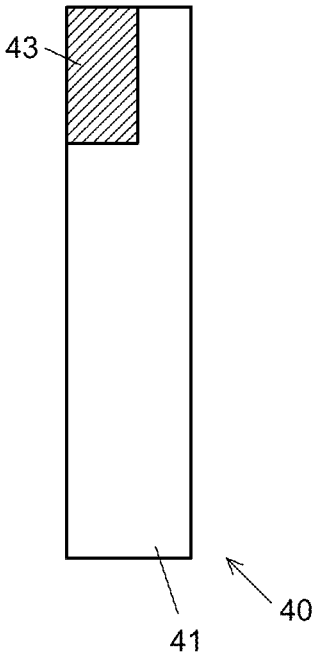

(3) Second Modified Example of MT-TOFMS According to Present Embodiment, and its Production Method The second modified example of the MT-TOFMS according to the present embodiment and its production method are hereinafter described with reference to FIGS. 9A and 9B. Though not shown, the MT-TOFMS according to the second modified example is identical in configuration to the MT-TOFMS 1 according to the previous embodiment except for the omission of the positioning pins 232 and the positioning-pin-fitting holes 2221 and 2222. According to the present modified example, the positioning of the compensating electrode 22 relative to the main electrode 21 is achieved by using a jig 40 as shown in FIGS. 9A and 9B in the process of producing the MT-TOFMS, as will be described later, instead of using the positioning pins 232 and the positioning-pin-fitting holes 2221 and 2222.

The jig 40 is a plate-shaped body 41 having three positioning pins 42 and one recess 43 formed on one face (which is hereinafter defined as the top surface). The recess 43 has a substantially identical shape to the compensating-electrode attachment part 23 with the compensating-electrode attachment surface 29 directed upward. The three positioning pins 42 are arranged so that they come in contact with the edge of the substrate 211 of the compensating electrode 22 if the substrate 221 is located at the correct position relative to the compensating-electrode attachment part 23 under the condition that the compensating-electrode attachment part 23 with the compensating-electrode attachment surface 29 directed upward is placed in the recess 43. Two of the three positioning pins 42 come in contact with the curved edge of the substrate 221 formed along the curve of the compensating electrode 22, while the remaining one comes in contact with the linear edge intersecting with the curved edge.

When the MT-TOFMS according to the present modified example is produced, the substrate 221 is fixed to the compensating-electrode attachment part 23 by initially placing the compensating-electrode attachment part 23 in the recess 43, with the compensating-electrode attachment surface 29 directed upward, then placing the substrate 221 so that its edge comes in contact with the three positioning pins 42, and connecting the two compensating-electrode-fixing bolts 26 to the compensating-electrode-fixing-bolt connection holes 223 through the two compensating-electrode-fixing-bolt insertion holes 233, respectively. Subsequently, the substrate 221 and the compensating-electrode attachment part 23 are removed from the jig 40, and the substrate-projecting portion 2211 of the substrate 221 is passed through the hole provided in the outer electrode 211. Ultimately, the compensating-electrode attachment part 23 is fixed to the attachment-part-fixing portion 2111 of the outer electrode 211. Thus, the position of the compensating electrode 22 on the substrate 221 is precisely set.

(4) Other Modified Examples

The present invention is not limited to the previous embodiment and two modified examples. It can be further modified in various forms.

For example, a compensating electrode which is similar to the compensating electrode 22 located in the vicinity of the ion inlet 24 in the previous embodiment and two modified examples may additionally be located in the vicinity of the ion outlet 25. It is also possible to omit the compensating electrode in the vicinity of the ion inlet 24 and only provide the compensating electrode in the vicinity of the ion outlet 25.

In the previous embodiment and two modified examples, the compensating electrode 22 is located at a position closer to the ion inlet 24 than the position in the loop orbit at which the ions introduced from the ion inlet 24 complete their first turn. The compensating electrode 22 may be located within a range equal to or less than 20 mm from the ion inlet 24, i.e. within a range equal to or less than the distance between the outer and inner electrodes 211 and 212. Alternatively, the compensating electrode 22 may be located at a position whose distance from the ion inlet 24 is larger than the distance between the outer and inner electrodes 211 and 212 as long as the position is within an area in which the influence of the distortion of the electric field due to the ion inlet 24 is present. The area in which such an influence of the distortion of the electric field is present can be appropriately determined by a preparative experiment or simulation. The same also applies in the case of the compensating electrode placed in the vicinity of the ion outlet 25.

In the first modified example, the positioning of the compensating electrode 32 relative to the substrate 321 is achieved by means of the positioning pins 332 provided on the substrate 321, while the positioning of the substrate 321 relative to the compensating-electrode attachment part 23 is achieved by means of the positioning pins 232 provided on the compensating-electrode attachment part 23. The substrate 321 and the compensating-electrode attachment part 23 may be prepared as an integral part without using the positioning pins 232. In that case, the integral part consisting of the substrate 321 and the compensating-electrode attachment part 23 is entirely handled as a compensating-electrode attachment part, and the compensating electrode 32 is directly attached to this compensating-electrode attachment part. The positioning of the compensating electrode 32 relative to the compensating-electrode attachment part is achieved by the positioning pins 332. The same also applies in the case of the compensating electrode placed in the vicinity of the ion outlet 25.

Modes of the Invention

A person skilled in the art can easily understand that the previously described illustrative embodiment and its modified examples are specific examples of the following modes of the present invention.

(Clause 1)

The multiturn time-of-flight mass spectrometer according to Clause 1 includes:

a main electrode configured to generate, within a predetermined loop-flight space, a loop-flight electric field which is an electric field that makes an ion fly in a loop orbit multiple times, the main electrode having an opening through which ions are introduced into or extracted from the loop-flight space;

a compensating-electrode attachment part made of an insulating material and fixed to the main electrode; and a compensating electrode configured to compensate for a distortion of the loop-flight electric field which occurs in the vicinity of the opening, the compensating electrode being fixed to the compensating-electrode attachment part directly or via a substrate and located in the vicinity of the opening.

In the multiturn time-of-flight mass spectrometer according to Clause 1, the compensating electrode is fixed to the main electrode via the compensating-electrode attachment part made of an insulating material. This allows the position of the compensating electrode relative to the main electrode to be more precisely set than in the conventional device. Therefore, the distorted electric field which occurs in the vicinity of the opening of the main electrode can be compensated for with a higher level of accuracy by the compensating electric field created by the compensating electrode, so that the downsizing of the device or an improvement in resolving power can be achieved.

(Clause 2)

The multiturn time-of-flight mass spectrometer according to Clause 2, which is a specific form of the multiturn time-of-flight mass spectrometer according to Clause 1, is configured as follows:

the compensating-electrode attachment part includes two positioning pins; and the compensating electrode or the substrate includes two fitting holes respectively provided for the two positioning pins.

In the multiturn time-of-flight mass spectrometer according to Clause 2, the position of the compensating electrode relative to the compensating-electrode attachment part can be even more precisely set, so that the distorted electric field can be compensated for with an even higher level of accuracy.

(Clause 3)

In the multiturn time-of-flight mass spectrometer according to Clause 3, which is a specific form of the multiturn time-of-flight mass spectrometer according to Clause 2, one of the fitting holes has a longer shape in one specific direction than one of the two positioning pins to be engaged with the fitting hole concerned.

In the multiturn time-of-flight mass spectrometer according to Clause 3, the two positioning pins 232 are prevented from being difficult to be inserted into the fitting holes due to a small amount of error that is within the tolerance.

(Clause 4)

In the multiturn time-of-flight mass spectrometer according to Clause 4, which is a specific form of the multiturn time-of-flight mass spectrometer according to one of Clauses 1-3, the substrate is configured to hold only a portion of the compensating electrode.

The multiturn time-of-flight mass spectrometer according to Clause 4 allows the substrate to be smaller in size and thereby suppresses the accumulation of electric charges ("charge-up") in the substrate.

(Clause 5)

The multiturn time-of-flight mass spectrometer according to Clause 5, which is a specific form of the multiturn time-of-flight mass spectrometer according to one of Clauses 1-4, is configured as follows:

the main electrode is formed by an outer electrode in which the opening is provided and an inner electrode located inside the outer electrode and at a predetermined distance from the outer electrode;

the loop-flight space is the space between the outer electrode and the inner electrode; and the compensating-electrode attachment part is located within the predetermined distance from the opening.

In the multiturn time-of-flight mass spectrometer according to Clause 5, the compensating electrode can be located within an area where the distortion of the electric field due to the presence of the opening significantly influences the loop orbit of the ions, so that the influence of the distortion of the electric field can be effectively reduced.

(Clause 6)

The method for producing a multiturn time-of-flight mass spectrometer according to Clause 6 is a method for producing a multiturn time-of-flight mass spectrometer including a main electrode configured to generate, within a predetermined loop-flight space, a loop-flight electric field which is an electric field that makes an ion fly in a loop orbit multiple times, the main electrode having an opening through which ions are introduced into or extracted from the loop-flight space, and a compensating electrode configured to compensate for a distortion of the loop-flight electric field which occurs in the vicinity of the opening, and the method including the steps of:

fixing the compensating electrode, or a substrate to which the compensating electrode is attached, to a compensating-electrode attachment part made of an insulating material, using a jig which includes a compensating-electrode-holding portion configured to hold the compensating electrode and a compensating-electrode-attachment-part-holding portion configured to hold the compensating-electrode attachment part at a predetermined position relative to the compensating electrode, with the compensating electrode held in the compensating-electrode-holding portion and the compensating-electrode attachment part held in the compensating-electrode-attachment-part-holding portion; and fixing the compensating-electrode attachment part at a position in the vicinity of the opening.

In the method for producing a multiturn time-of-flight mass spectrometer according to Clause 6, the position of the compensating electrode or the substrate to which the compensating electrode is attached can be more precisely set relative to the compensating-electrode attachment part by fixing the compensating electrode or the substrate to the compensating-electrode attachment part, with the compensating electrode held in the compensating-electrode-holding portion and the compensating-electrode attachment part held in the compensating-electrode-attachment-part-holding portion. The distorted electric field can thereby be compensated for with an even higher level of accuracy.

REFERENCE SIGNS LIST

1 . . . TOFMS
11 . . . Ion Source
12 . . . Ion Detector
20 . . . Ion Flight Unit
21 . . . Main Electrode
211 . . . Outer Electrode
2111 . . . Attachment-Part-Fixing Portion
2112 . . . Main-Electrode-Fixing-Bolt Connection Hole
212 . . . Inner Electrode
218 . . . Orbit of Ions
219 . . . Loop-Flight Space
210 . . . Portion of Ions Introduced from Ion Inlet
22, 32 . . . Compensating Electrode
221, 321 . . . Substrate
2211 . . . Substrate-Projecting Portion
2221, 2222, 3221, 3222, 3241, 3242 . . . Positioning-Pin-Fitting Hole
223, 323 . . . Compensating-Electrode-Fixing-Bolt Connection Hole
23 . . . Compensating-Electrode Attachment Part
231 . . . Body of Compensating-Electrode Attachment Part
232, 332 . . . Positioning Pin
233 . . . Compensating-Electrode-Fixing-Bolt Insertion Hole
234 . . . Main-Electrode-Fixing-Bolt Insertion Hole
24 . . . Ion Inlet
25 . . . Ion Outlet
26 . . . Compensating-Electrode-Fixing Bolt
27 . . . Main-Electrode-Fixing Bolt
29 . . . Compensating-Electrode Attachment Surface
324 . . . Conductor
40 . . . Jig
41 . . . Body of Jig
42 . . . Positioning Pin on Jig
43 . . . Recess

The invention claimed is:

1. A multiturn time-of-flight mass spectrometer, comprising:

a main electrode configured to generate, within a predetermined loop-flight space, a loop-flight electric field which is an electric field that makes an ion fly in a loop orbit multiple times, the main electrode having an opening through which ions are introduced into or extracted from the loop-flight space;

a compensating-electrode attachment part made of an insulating material and fixed to the main electrode; and a compensating electrode configured to compensate for a distortion of the loop-flight electric field which occurs in a vicinity of the opening, the compensating electrode being fixed to the compensating-electrode attachment part directly or via a substrate and located in the vicinity of the opening.

2. The multiturn time-of-flight mass spectrometer according to claim 1, wherein:

the compensating-electrode attachment part includes two positioning pins; and the compensating electrode or the substrate includes two fitting holes respectively provided for the two positioning pins.

3. The multiturn time-of-flight mass spectrometer according to claim 2, wherein:

one of the fitting holes has a longer shape in one specific direction than one of the two positioning pins to be engaged with the fitting hole concerned.

4. The multiturn time-of-flight mass spectrometer according to claim 1, wherein:

the substrate is configured to hold only a portion of the compensating electrode.

5. The multiturn time-of-flight mass spectrometer according to claim 1, wherein:

the main electrode is formed by an outer electrode in which the opening is provided and an inner electrode located inside the outer electrode and at a predetermined distance from the outer electrode;

the loop-flight space is a space between the outer electrode and the inner electrode; and the compensating-electrode attachment part is located within the predetermined distance from the opening.

6. A method for producing a multiturn time-of-flight mass spectrometer including a main electrode configured to generate, within a predetermined loop-flight space, a loop-flight electric field which is an electric field that makes an ion fly in a loop orbit multiple times, the main electrode having an opening through which ions are introduced into or extracted from the loop-flight space, and a compensating electrode configured to compensate for a distortion of the loop-flight electric field which occurs in a vicinity of the opening, and the method comprising steps of:

fixing the compensating electrode, or a substrate to which the compensating electrode is attached, to a compensating-electrode attachment part made of an insulating material, using a jig which includes a compensating-electrode-holding portion configured to hold the compensating electrode and a compensating-electrode-attachment-part-holding portion configured to hold the compensating-electrode attachment part at a predetermined position relative to the compensating electrode, with the compensating electrode held in the compensating-electrode-holding portion and the compensating-electrode attachment part held in the compensating-electrode-attachment-part-holding portion; and fixing the compensating-electrode attachment part at a position in the vicinity of the opening.

* * * * *